United States Patent [19]

Eliot

[11] Patent Number: 4,807,879

[45] Date of Patent: Feb. 28, 1989

[54] BALL RETURN/TARGET ASSEMBLY FOR RACQUET SPORTS

[76] Inventor: Joseph C. Eliot, 400 Glendale Rd., A-50, Havertown, Pa. 19083

[21] Appl. No.: 149,655

[22] Filed: Jan. 28, 1988

[51] Int. Cl.[4] ..... A63B 69/38

[52] U.S. Cl. ..... 273/29 A; 273/378; 273/386; 273/390; 273/396; 273/407; 273/DIG. 8

[58] Field of Search ..... 273/29 R, 26 A, 29 A, 273/410, 30, 348, 372, 375, 378, 383, 386, 387, 390, 396, 395

[56] References Cited

U.S. PATENT DOCUMENTS

| | | | |
|---|---|---|---|
| 1,692,042 | 11/1928 | Koizumi | 273/383 |
| 1,733,606 | 10/1929 | Junker | 273/375 |
| 2,777,695 | 1/1957 | Cohn | 273/386 |
| 2,957,694 | 10/1960 | Barber et al. | 273/390 |
| 3,411,784 | 11/1968 | Lawrence | 273/390 |
| 3,692,307 | 9/1972 | Henry | 273/29 A |
| 3,963,240 | 6/1976 | Tidwell | 273/395 |
| 4,183,524 | 1/1980 | Kifferstein et al. | 273/29 A |
| 4,456,251 | 1/1984 | Balaz | 273/29 A |

*Primary Examiner*—Richard C. Pinkham
*Assistant Examiner*—T. Brown
*Attorney, Agent, or Firm*—Steele, Gould & Fried

[57] ABSTRACT

A ball return/target for racquet sports includes a resilient pad and at least one disk suspended from the pad by a filament. The pad is flexible polyurethane open cell foam of a thickness to cause a projectile hitting it to be deflected back at the source. The disk is a double thickness of fabric or like material with two faces, each face visually distinguishable from the other. When a projectile hits the suspended disk on one face, the disk rotates 180° exposing the other face to give evidence that the target had been hit.

15 Claims, 2 Drawing Sheets

BALL RETURN/TARGET ASSEMBLY FOR RACQUET SPORTS

BACKGROUND OF THE INVENTION

1. Field of the Invention

This invention relates to amusement devices and games and, more particularly, to an aerial projectile target.

2. Description of the Prior Art

In racquet sports training it is important to be able to practice alone, without a partner returning the ball. Presently, two methods of practice are employed. One method involves hitting the ball against a stationary wall, while another method uses a ball rebound device, usually a net which is stretched taut. Traditionally, ball rebound devices cause a ball rebounding from the wall, net or backing board to rebound very quickly—too quickly for the beginning player to respond correctly. The typical net rebound device has an additional disadvantage—it must be hit with great force in order to cause the ball to rebound. The traditional outdoor tennis practice wall or ball rebound device requires a great deal of space and a smooth surface on which to play.

In addition to the aforementioned problems, the traditional ball rebound devices do not indicate if the ball has been hit or thrown correctly or if the player has hit an exact spot on the target. It is very important that the player know if his technique is producing the desired results. To this end, marking of a target at each hit is therefore a valuable asset. Most traditional ball rebound devices do not give evidence that the desired target spot has been hit, and those which do require constant resetting.

There are other devices on the market intended to training in the racquet sports or for game playing. Some are intended to serve primarily as targets, some as ball rebound devices. Among the ball rebound devices is the Tennis Go-Go Trainer, a device consisting of a resilient pad held against a flat wall. It uses no target and requires an adjacent smooth horizontal surface for the ball to bounce upon.

Lastly, there are no available ball return/target devices which may be safely and easily used inside a house.

There is, therefore, a need for a ball return/target assembly which continuously returns the ball to the player for uninterrupted strokes, gives evidence of the target being struck, and does not require an adjacent smooth surface for ball bounce at each stroke. Providing a target usable in a confined space, such as inside a house, is also highly desirable.

SUMMARY OF THE DISCLOSURE

The aforementioned prior art problems are obviated by the ball return/target assembly of this invention. A resilient backing board, preferably a flexible polyurethane open cell foam pad, is employed. Preferably, the pad is rectangular, about thirty-six inches, by about forty inches by about four inches thick. Suspended from the pad is at least one two-faced disk, the faces being visually distinguishable from each other by, for example, being different colors. The disk is preferably a very thin double thickness of plastic tape or stiffened fabric and has a diameter of about one inch and a thickness of about one millimeter. The disk is suspended by a filament, preferably polyester thread, extending about one inch from the backing board pad to provide a light weight target. When a player hits a plastic ball (such as practice golf ball or small Whiffle ball) with a racquet at the target, if the projectile hits the dangling disk with the proper force and spin, the disk will bound and rotate 180° about the filament attachment point to expose the other disk face. The player then knows that he has properly hit the target. The ball, because of the pad backing board, will then rebound to the player who may then return the ball with another stroke of the racquet.

In the preferred embodiment, the foam pad is held in the desired position on a tripod and disks suspend from both sides of the pad, which may be physically rotated to double the useful life of the target assembly.

In a training exercise, the player may alternate forehand and backhand strokes, trying to hit the ball against the disk gauging his success by observing if the disk rotates. Also, the player subconsciously acquires stroking techniques as he consciously participates in a game of flipping the target from side to side.

It is, therefore, an object of this invention to provide a ball return/target assembly for use in a racquet sports which utilizes a foam backing pad as a rebound device and a featherweight disk as a visible indication of successful hits.

It is a further object of this invention to provide a ball return/target assembly which is small and convenient for use in the home.

It is another object of this invention to provide a target which utilizes a two-faced lightweight disk as an indicator of a successful hit.

It is yet another object of this invention to provide a ball return/target assembly which is light in weight and simple in structure so that it can be assembled, disassembled, stored, and manipulated by children.

It is yet a further object of this invention to provide a target which does not require constant resetting, but which automatically indicates a successful hit and is immediately ready for reuse, thereby premitting continuous, uninterrupted stroking practice.

It is another object of this invention to provide a ball return/target assembly which is not wall hung.

It is still another object of this invention to provide a ball return/target for sports training, activities, and games which is useful for hand thrown projectiles as well as racquet propelled projectiles.

It is yet a further object of this invention to provide a ball return/target which produces rebounds that simulate, for the purpose of continuous stroking practice, an opponent's return in an actual game.

These and other objects will be more readily ascertainable to one skilled in the art from a consideration of the following Figures, description and exemplary embodiments.

BRIEF DESCRIPTION OF THE DRAWING(S)

DETAILED DESCRIPTION OF THE PREFERRED EMBODIMENT(S)

In the following description, ball and projectile are used interchangably to indicate that, while a ball is preferred, other projectiles are possible.

Figure 1:
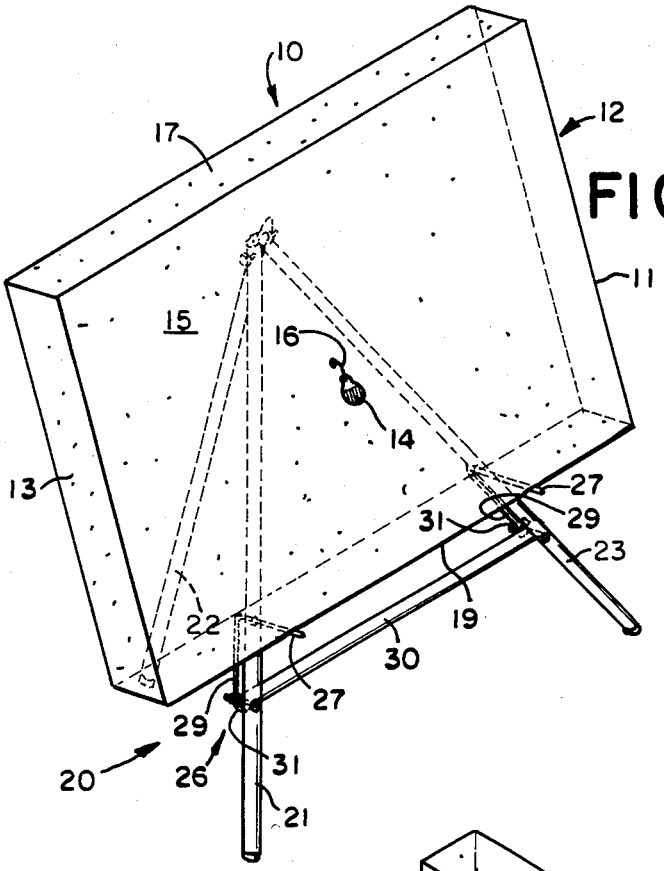
FIG. 1 is an isometric view of the ball return/target assembly of this invention positioned on a tripod.

Referring now to the drawings, and more particularly to FIG. 1, ball return/target assembly 10 is seen supported at an angle on tripod 20. Tripod 20 has legs 21, 22 and 23 and crossbar 30. Pad 12 rests on brackets 26. Tripod 20 and brackets 26 are discussed in detail in reference to FIG. 4. It is preferred that backing board pad 12 be supported on a tripod. But it may be rested on a wall or table and still be an effective ball return and target. Backing board pad 12 is seen having side 15, ends 11 and 13, top 17 and bottom 19. Seen suspended by filament 16 from the proximate center of pad 12 is disk 14 which serves as the ultimate target for this assembly.

Figure 2:
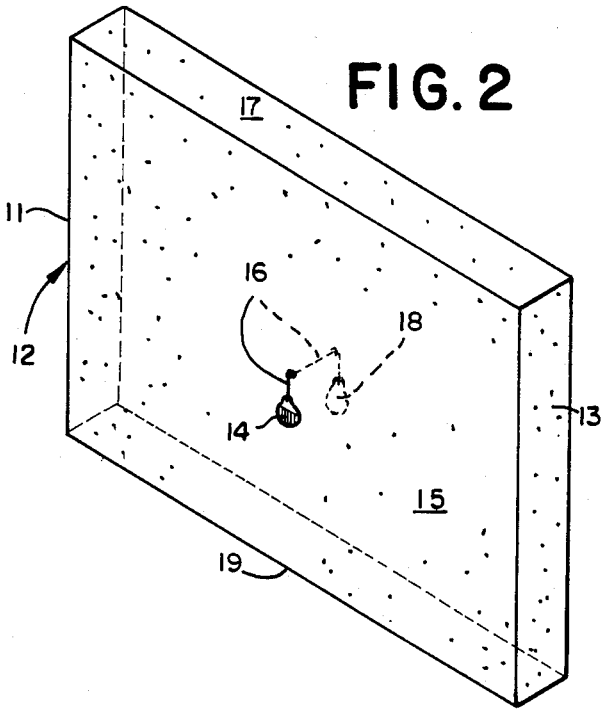
FIG. 2 is an isometric view of the backing board pad with two disks suspended, one each on a pad side.

Now referring to FIG. 2, pad 12 of the preferred embodiment of ball return/target assembly 10 is seen having two disks 14 and 18, one each on each pad side. Backing board pad 12 is seen to have side 15, top 17, bottom 19, and ends 11 and 13. Filament 16 is seen with disks 14 and 18 suspended from its ends. It is preferred that a filament have a disk on each filament end. Not only does this provide for adjustable positioning of the disk target, but it encourages use of both pad sides, extending the life of ball return/target assembly 10. It is preferred, for best rotation of target disk 14 that filament 16 be of a length that allows about one inch of filament between the pad 12 and disk 14. Thus, if the pad is four inches thick, filament 16 should be about six inches in length so that each disk may hang from one inch of filament. It is, of course possible to have a longer filament and to adjust to the best position by pulling filament 16 through pad 12 on the side in use or on the side which is not being used.

In the preferred embodiment, pad 12 is 36 inches high, 40 inches long, and four inches wide. It is preferred that pad 12 by flexible polyurethane open cell foam with a density of about 1.8 to 2.5 pounds per cubic foot and an indentation force deflection of from about 40 pounds to about 100 pounds. With such a composition, pad 12 forcefully rebounds a projectile, such as a practice golf ball or small Whiffle ball in a true arc and at a returnable height.

Disk 14 is suspended by filament 16 which is, preferably, about a six inch length of carpet thread, or other polyester thread. It has been found that the best and easiest method of suspending disks 14 is by pulling filament 16 through pad 12 with a sculpturing needle, or the like, and attaching each end to a disk.

Although only two disks are illustrated in FIG. 2, it is possible to have a plurality of disks on each backing board pad side or, conversely, to have disks on only one pad side. The number and position of the disks is optional, but it is preferred that there be at least two disks suspended from a common filament, each pad side having one disk suspended therefrom.

Figure 3:
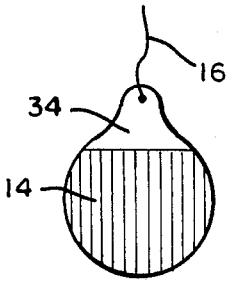
FIG. 3 is an enlarged front view of one face of the reinforced disk of this invention.

Now referring to FIG. 3, an enlarged view of disk 14 is illustrated. Disk 14 is preferably made of two layers of cloth or plastic tape glued together and preferably includes a reinforced bulge 34 in which the filament 16 is attached. Coated paper, such as "Contact" paper is also suitable for the disk. Bulge 34 provides the filament attachment at a point away from the center of disk 14, allowing free movement of disk 14 when it is hit by a projectile. Reinforcement can easily be done by covering the bulge area 34 with strapping tape, or the like. Although a reinforced area at the point of filament attachment is preferable to prevent the filament from tearing the disk, it is optional.

Although disk 14 is shown as a circle with a reinforced bulge for filament attachment, other shapes are possible. It is desirable to have a target with rounded edges, since angled edges would catch in the foam pad and not respond properly to being struck by a projectile.

Figure 4:
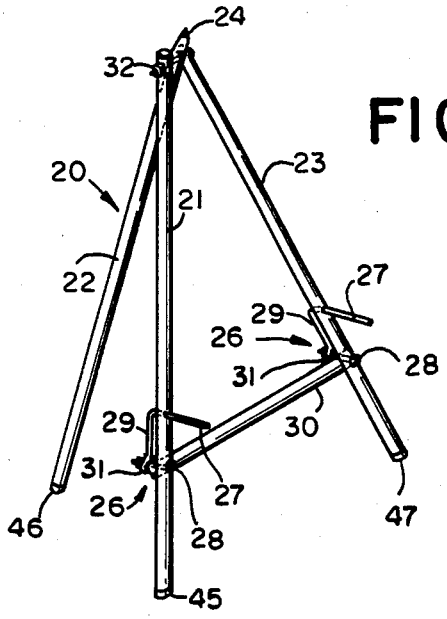
FIG. 4 is an isometric view of the tripod to illustrate its pad retaining means.

Now referring to FIG. 4, the preferred tripod 20 of this invention is illustrated. Tripod 20 has legs 21, 22 and 23. Leg 22 is the center-most leg and is tapered at tip 24. All three legs have capped feet, 45, 46 and 47 respectively. Bolt 32 joins legs 21, 22, and 23 proximate their tips. When the foot of leg 22 is moved backwards to form the tripod into its standing position, tapered tip 24 breaks the plane formed by the front of legs 21 and 23 and protrudes into resilient pad 12, anchoring the top of pad 12 to prevent lateral movement.

Additionally, pad 12 is supported by brackets 26 which are positioned one each on leg 21 and 23 at the point of attachment of crossbar 30. Crossbar 30 stabalizes legs 21 and 23. Brackets 26 each have two legs 27 and 29. Each leg 29 has an eyelet at its extremity (not seen). Legs 27 of brackets 26 are inserted from the back of the legs through predrilled holes in tripod legs 21 and 23 to extend outward from the legs. Bolts 28, fastened from the rear of the legs, hold both a bracket 26 (through its eyelet) and crossbar 30 to each of legs 21 and 23. When pad 12 is positioned on the tripod as in FIG. 1, its bottom 19 rests on legs 27 and the weight of pad 12 causes legs 27 to sink into bottom 19, preventing lateral movement of pad 12.

Figure 5:
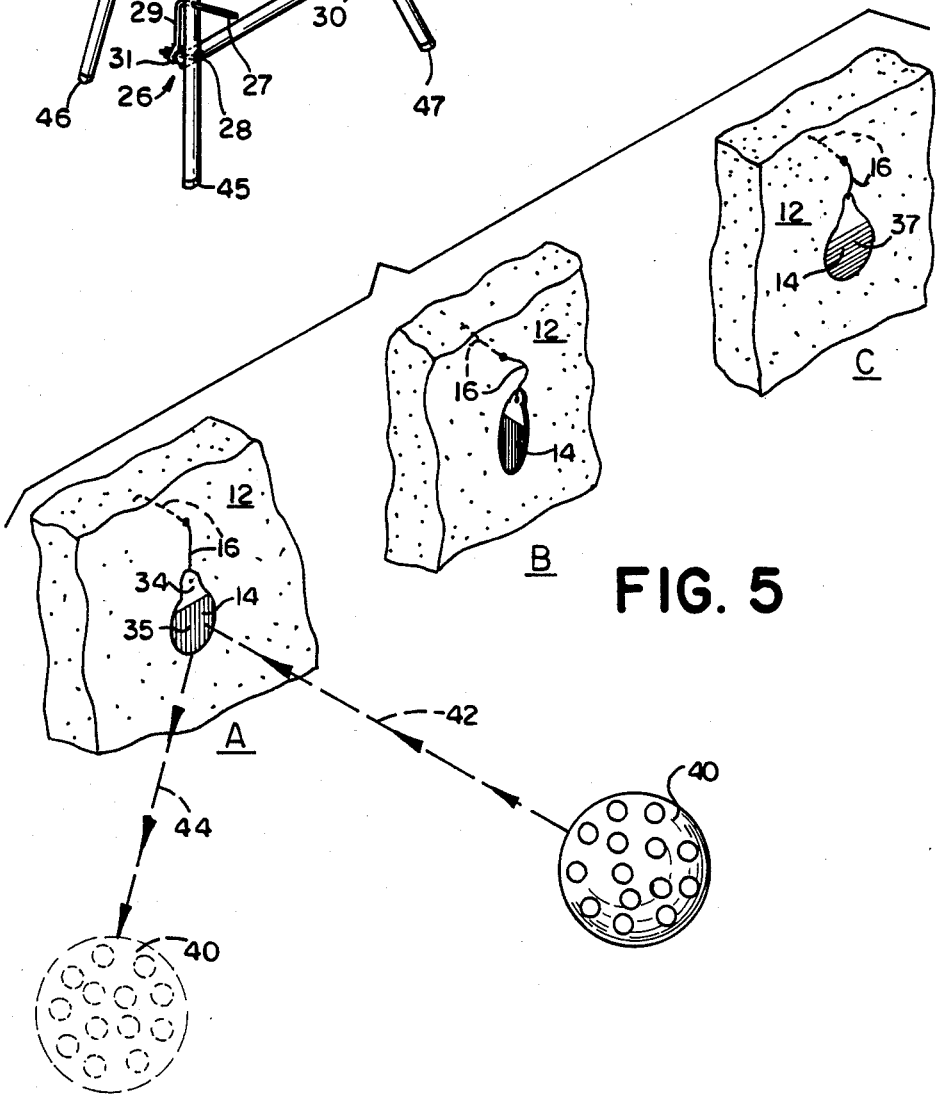
FIG. 5 is a diagrammatic view illustrating a disk turning in response to a hit from a ball.

Now referring to FIG. 5, a method of using ball return/target assembly 10 is pictured in sequence, showing disk 14 rotating in reponse to being hit by a projectile. In the preferred training method, a player uses a practice golf ball or small Whiffle ball which he hits with a small racquet. It is, of course, possible to use the ball return/target assembly of this invention by throwing a projectile against the target as well as by hitting different sized balls with racquets of different sizes. It is preferred that the ball used be only slightly larger than the disk; therefore, when a tennis ball, for example is used, the target's disk would be larger also.

In position A, disk 14 is seen suspended from pad 12 by filament 16 with face 35 facing the player. Whiffle ball 40 is struck by a racquet so that ball 40 hits disk 14. The force of the impact of ball 40 on pad 12 and disk 14 causes disk 14 to bounce and rotate, as illustrated by position B. As disk 14 continues to rotate, it assumes the position illustrated in position C with visually different face 37 facing the player.

In addition to giving evidence of a "hit", ball return/-target assembly 10 rebounds ball 40. For example, if ball 40 is struck so that it travels in the direction of arrow 42, the resiliency of pad 12 will force ball 40 back towards the user in the direction of arrow 44, which is at an angle and slightly arced upward because of the angle of the pad on tripod 20. It is this rebounding of the ball at an angle and upward which makes this device particularly useful for training in racquet sports. If the player hits the ball with a forehand stroke, the ball will strike the target and come back at an angle, not in a direct line to his forehand. Either the player is forced to run to position himself properly to re-return the ball, or he is forced to use his backhand stroke to return the ball. It is this alternating of strokes which is particularly beneficial to the beginning player.

In training a player, the player may continuously alternate stroking the ball on the forehand and backhand sides of his body while engaging consciously in a selected game of trying to cause the disk to flip. In his effort to return the ball on each rebound and to cause the disk to flip the 180° to expose the other disk face, the player subconsciously acquires a facility for hitting the ball because the continuous and alternating movements of the game require that he properly align his body and use his racquet in the proper way.

By adjusting the angle at which pad 12 rests on tripod 20, the user may practice other basic racquet strokes such as the serve, overhead smash, half volley, lob, drop shot and drop volley. The smaller the angle of the pad, the greater the speed at which the ball will rebound and the less arc it will take. Thus, beginning players may set the pad to be angled so that the playing face is angled away from the vertical. More experienced players will adjust the pad so that it approaches the vertical. The ease with which the angle, the degree of the arc, and the speed of the rebound may be adjusted and controlled makes it possible to use this device with players of various degrees of expertise.

It is critical to the assembly of this invention that the disk be sufficiently lightweight to cause it to rotate.

There are several variations which can be practiced in the scope of this invention. Primarily, the ball return/target assembly of this invention may be used with or without the tripod. The disk size and number may vary according to the racquet and ball being used. The materials of composition may vary as long as the pad is composed of a resilient material which will cause the ball to rebound and the disk to flip.

Simple experimentation following the parameters set forth herein will readily allow the user to perfect the exact disk size and weight to achieve the rotation necessary. The disk may be made of cloth or plastic tape, or coated paper. It may be cut from two-faced material or it may be composed of two sheets of material glued together. It may be reinforced with tape at the point of filament attachment. The disk may be other then rounded.

The game may be played by tossing a projectile with one's hands or by using a racquet and ball.

There are many advantages to the target assembly of this invention. Primarily, this ball return/target assembly is simple to use, lightweight, and safe to use inside. Also, it is a useful training device for both the beginner and the expert, or it may be used as a game.

Having now illustrated and described my invention, it is not intended that such description limit this invention, but rather that this invention be limited only by reasonable interpretation of the appended claims.

What is claimed is:

1. A ball return/target assembly for racquet sports comprising:

(a) a resilient backing board pad;

(b) at least one disk suspended from said pad, said disk being generally flat with two faces and of a weight predetermined to cause said disk to bounce and rotate 180° in response to the impact of a projectile against said disk; and, (c) a filament attached to said disk and to said pad to suspend said disk so that one said disk face rest flat against said pad's surface.

2. The ball return/target assembly for racquet sports according to claim 1 wherein said pad is flexible polyurethane open cell foam.

3. The ball return/target assembly for racquet sports according to claim 2 wherein said foam has an indentation force deflection of from about 40 to 100 pounds.

4. The ball return/target assembly for racquet sports according to claim 2 wherein said foam has a density of from about 1.8 to about 2.5 pounds per cubic foot.

5. The ball return/target assembly for racquet sports according to claim 1 wherein said disk is a double thickness of fabric and has a diameter from about three-quarters of an inch to about three andone-half inches an a thickness of about one millimeter.

6. The ball return/target assembly for racquet sports according to claim 5 wherein said disk is cloth tape and includes a reinforced area proximate the point of attachment to said filament.

7. The ball return/target assembly for racquet sports according to claim 5 wherein said disk is plastic film tape and includes a reinforced area proximate the point of attachment to said filament.

8. The ball return/target assembly for racquet sports according to claim 1 wherein there are two disks, one each suspended from each side of said pad, said disks joined by said filament extending through said pad's thickness, said filament having a length at least one-half inch greater than the thickness of said pad.

9. The ball return/target assembly for racquet sports according to claim 1 wherein each said disk face is visually distinguishable from said opposing disk face.

10. The ball rebound/target assembly for racquet sports according to claim 1 wherein there are a plurality of disks suspended on the surface of said pad.

11. The ball rebound/target assembly for racquet sports according to claim 1 wherein said filament is a polyester, rayon-wrapped thread.

12. A ball return/target assembly for racquet sports comprising:

(a) a resilient polyurethane open cell foam pad of a size to permit its use as a backing board;

(b) at least one disk suspended from said pad, said disk being generally flat with two faces, each said disk face being visually distinguishable from said other disk face, said disk having a diameter from about three-quarters of an inch to about one and one-half inches and being of a predetermined weight to cause said disk to bounce and rotate 180° in response to the impact of a spherical projectile against said face; and, (c) a filament attached to said disk and to said pad to suspend said disk so that one disk face rests flat against said pad's surface, whereby when a user strikes said target with a spherical projectile, said disk rotates 180° so that said opposing disk side rests against said pad.

13. A ball return/target assembly for racquet sports comprising:

(a) a resilient foam pad of a size to permit its use as a backing board;

(b) at least one disk suspended from said pad, said disk being generally flat with two faces, said disk being of a predetermined weight to cause said disk to bounce and rotate 180° in response to the impact of a projectile against said disk face;

(c) a filament attached to said pad and to said disk to suspend said disk so that one disk face rests flat against said pad; and, (d) means to support said pad at a height and inclination suitable for causing a ball striking said pad to rebound to the player.

14. The ball return/target assembly for racquet sports according to claim 13 wherein said means to support said pad is a tripod, said tripod including means to hold said pad to said tripod.

15. A method of training racquet sports players using a ball, racquet, and ball return/target assembly comprising the steps of:

(a) providing a resilient pad of a size to be used as a backing board;

(b) providing means to mount said pad at a height and inclination suitable for causing a ball striking said pad to rebound to a player;

(c) providing at least one disk suspended from said pad, said disk being generally flat with two faces, said faces being visually distinguishable and being of a predetermined weight to cause said disk to bounce and rotate 180° in response to the impact of a projectile against said face;

(d) providing a filament attached to said disk; and, (e) suspending said disk from said pad by said filament so that one disk face rests flat against said pad's surface so that a user hitting a ball which strikes said disk causes said disk to rotate 180°.

* * * * *

UNITED STATES PATENT AND TRADEMARK OFFICE

CERTIFICATE OF CORRECTION

PATENT NO. : 4,807,879

DATED : Feb. 28, 1989

INVENTOR(S) : Joseph C. Eliot

It is certified that error appears in the above-identified patent and that said Letters Patent is hereby corrected as shown below:

Column 1, line 35: Change "to" to read "for"

Column 2, line 23: Delete "a" between "in" and "racquet"

Column 3, line 41: Change "by" to read "be"

Column 6, line 13: Change "three andone-half inches an a" to read "three and one-half inches and a"

Signed and Sealed this

Twenty-first Day of November, 1989

*Attest:*

JEFFREY M. SAMUELS

*Attesting Officer* *Acting Commissioner of Patents and Trademarks*